US006930697B2

(12) United States Patent
Tanaka

(10) Patent No.: US 6,930,697 B2
(45) Date of Patent: Aug. 16, 2005

(54) TAPE PRINTING DEVICE

(75) Inventor: Mitsugi Tanaka, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 70 days.

(21) Appl. No.: 10/728,776

(22) Filed: Dec. 8, 2003

(65) Prior Publication Data

US 2004/0155951 A1 Aug. 12, 2004

(30) Foreign Application Priority Data

Dec. 20, 2002 (JP) ..... 2002-369504

(51) Int. Cl.[7] ..... B41J 3/36
(52) U.S. Cl. ..... 347/222
(58) Field of Search ..... 347/220, 222, 347/197; 400/120.16, 648

(56) References Cited

U.S. PATENT DOCUMENTS 5,839,840 A 11/1998 Kawano
6,332,725 B1 * 12/2001 Palmer et al. ..... 400/615.2
6,435,744 B1 8/2002 Dunn et al.

FOREIGN PATENT DOCUMENTS

| | | |
|---|---|---|
| EP | 1 120 263 A2 | 8/2001 |
| JP | A 8-25753 | 1/1996 |
| JP | A 10-100494 | 4/1998 |

* cited by examiner

*Primary Examiner*—Huan Tran
(74) *Attorney, Agent, or Firm*—Oliff & Berridge, PLC

(57) ABSTRACT

A tape printing device prints letters/characters on a tape-form thermal recording medium. The tape printing device is provided with a device body, a cassette holding section being formed in the device body to accommodate a tape cassette containing the tape-form recording medium, a cover member that covers the cassette holding section, a thermal head that applies heat to print letters/characters on the tape-form recording medium, a thermal head mounting portion formed on a bottom of the cassette holding section, the thermal head mounting portion including a plate-like member that protrudes from the bottom of the cassette holding section toward the cover member, the thermal head being attached to a side of the plate-like member, and a platen mechanism having a platen which faces the thermal head and is biased toward the thermal head.

23 Claims, 12 Drawing Sheets

TAPE PRINTING DEVICE

BACKGROUND OF THE INVENTION

The present invention relates to a tape printing device that is configured such that a tape-form thermal recording medium (hereinafter, simply referred to as a tape) is pressed against a thermal head, letter/characters are printed on the tape, and a portion of the tape on which the letters/characters are printed is discharged to outside.

Conventionally, various types of tape printing devices are proposed. An example of the conventional tape printing devices is configured such that the tape is fed by a platen mechanism, which is movable between an operating position and a standby position in association with an attachment/detachment (i.e., attaching/detaching or opening/closing) of a back cover for covering a cassette holding section. Then, the tape is pressed against a thermal head by the platen. The thermal head applies heat to the tape in accordance with print data to form letters/characters on the tape. Then, the printed portion of the tape is discharged outside.

Examples of the tape printing device are further described. In Japanese Patent Provisional Publication No. HEI 08-25753, a tape printing device provided with a tape feeding mechanism, a thermal head for forming letters/characters on the tape, a platen that is retractably urged toward the thermal head is disclosed. The tape feeding mechanism, the thermal head and the platen are provided within a frame of a tape cassette holding section that accommodates a tape cassette. Further, in this publication, the platen is supported by a platen holder that is swingably supported by a holder shaft. The holder shaft stands on a base plate, and a head supporting member mounting a thermal head is disposed on the base plate. The position of the thermal head with respect to the platen is previously adjusted, and the base plate is secured on the frame by means of screws.

For another example, U.S. Pat. No. 5,839,840 discloses a tape printer having a platen mechanism which moves between an operable position and a retracted position in association with attachment/detachment of a back cover that covers a tape cassette holding section. In this example, when the back cover is attached to the tape printer, an engaging protrusion standing on an inner surface of the back cover is interposed between the movable platen and a fixed member, thereby the platen holder is swung toward the tape cassette until a portion of the tape is pressed against the thermal head by the platen.

In the above-mentioned prior art in which the holder shaft stands on the base plate and the head supporting member provided with the thermal head is mounted on the base plate with the position thereof previously adjusted, the head supporting member is typically made as a metal member, which is produced, for example, by aluminum die-casting. Thus, it is necessary to secure the head supporting member on the base plate made of metal by means of screws, which raises a problem of increasing working processes and a manufacturing cost.

In the configuration in which the engaging protrusion formed on the inner surface of the back cover is interposed between the platen holder and the fixing member to swing the platen holder toward the tape cassette to urge the tape of the tape cassette against the thermal head, the supporting plate provided in the tape mounting portion for supporting the thermal head is typically made of resin. Therefore, the supporting plate can be formed by a single resin molding process, and hence the manufacturing cost can be reduced.

However, when it is used at high temperatures for a long time, a problem raises that creep deformation of the supporting plate occurs in a direction pressed by the platen holder. When the deformation occurs, the printing quality is deteriorated.

SUMMARY OF THE INVENTION

The present invention is advantageous in that the above-mentioned problem can be solved. That is, according to the invention, there is provided an improved tape printing device by which the thermal head mounting member on which the thermal head is to be mounted can be formed integrally with the cassette holding section in a single resin molding process to reduce the manufacturing cost. Further, the creep deformation of the thermal head mounting member can be prevented even if the tape printing device is stored or used in high temperature environment for a long time, and hence deterioration of tape printing quality can be prevented for a long time.

According to an aspect of the invention, there is provided a tape printing device that prints letters/characters on a tape-form thermal recording medium. The tape printing device is provided with a device body, a cassette holding section being formed in the device body to accommodate a tape cassette containing the tape-form recording medium, a cover member that covers the cassette holding section, a thermal head that applies heat to print letters/characters on the tape-form recording medium, a thermal head mounting portion formed on a bottom of the cassette holding section, the thermal head mounting portion including a plate-like member that protrudes from the bottom of the cassette holding section toward the cover member, the thermal head being attached to a side of the plate-like member, and a platen mechanism having a platen which faces the thermal head and is biased toward the thermal head.

Further, the thermal head mounting portion has an abutting member, and the cover member has a regulating member. The abutting member and the regulating member are configured such that the abutting member abuts the regulating member from a direction opposite to a direction in which the platen is biased toward the thermal head at least when the cover member covers the cassette holding section, deformation of the plate-like member urged by the platen being prevented as a displacement of the abutting member is prevented by the regulating member.

Optionally, the abutting member may include a protruded member protruding from a side end surface of the plate-like member.

Further optionally, the regulating member is formed on an inner surface, which faces the thermal head mounting portion, of the cover member. In this case, the protruded member may be configured to have a substantially circular cross section along a plane perpendicular to a protruding direction of the protruded member.

Furthermore, the protruded member has a substantially semicircular cross section along a plane perpendicular to a protruding direction of the protruded member, a convex surface of the protruded member facing the regulating member.

Optionally, the regulating member has a receiving portion that receives the protruded member, at least a portion of the receiving portion abutting the protruded member having a concave shape fitting to the shape of the protruded member.

In a particular case, the platen mechanism is configured such that the platen moves between an operating position at which the platen is biased toward the thermal head and a standby position at which the platen is retracted from the operating position, and the abutting member faces the regulating member only when the platen is located at the operating position.

Still optionally, the cover member is detachably attached to the body, and the platen mechanism is configured such that the platen moves between an operating position at which the platen is biased toward the thermal head and a standby position at which the platen is retracted from the operating position in association with attachment/detachment of the cover member with respect to the body.

Further optionally, the platen mechanism has a moving mechanism that moves the platen between the operating position and the standby position, and the cover member has a protrusion portion formed on the inner surface of the cover member, the protrusion portion affecting the moving mechanism to move the platen.

In this case, the abutting member may include a protruded member protruding from a side end surface of the plate-like member, and the regulating member may be formed on the inner surface, which faces the thermal head mounting portion, of the cover member.

Further, the cover member may include a pair of first ribs, the first ribs being formed on the inner surface of the cover member and extending from both sides of the regulating member.

Furthermore, the cover member may include a pair of second ribs, the second ribs being formed on the inner surface of the cover member and extending from both sides of the protrusion portion.

Optionally, the first ribs and the second ribs are joined between the regulating member and the protrusion portion.

Still optionally, a distance between the regulating member and the protrusion portion may be determined such that the platen is urged against the thermal head at a predetermined force.

In a certain case, the regulating member and the protrusion portion are formed integrally with the cover member.

Further optionally, the thermal head mounting member and the cassette holding section are formed of resin.

Alternatively or optionally, the cover member is made of resin.

Further optionally, the thermal head mounting member is formed integrally with the cassette holding section.

Still optionally, the platen mechanism may include a platen roller, and a biasing mechanism that biases the platen roller toward the thermal head, and the abutting portion may be formed on the cover member side end portion of the thermal head mounting member such that it faces a rotation axis of the platen roller when the platen mechanism is at the operating position.

Furthermore, the platen mechanism may include a swinging mechanism that swings the platen mechanism from the operating position to the standby position about a fixed point, the cover member has a protrusion portion formed on the inner surface, and the protrusion portion presses an outer side of the platen mechanism to move the platen mechanism from the standby position to the operating position against the swinging means.

According to another aspect of the invention, there is provided a tape printing device that prints letters/characters on a tape-form thermal recording medium, which is provided with a device body, a cover member that covers detachably attached to the device body, a thermal head that applies heat to the tape-form recording medium so as to print letters/characters thereon, a thermal head mounting portion provided to the device body, the thermal head mounting portion including a plate-like member that extends from the device body toward the cover member, the thermal head being attached to a side of the plate-like member, a platen mechanism having a platen which faces the thermal head and is biased toward the thermal head, and a supporting mechanism provided between the thermal head mounting portion and the cover member. The supporting mechanism is configured to support the plate-like member from a side opposite to the platen to prevent deformation of the plate-like member due to biasing force applied by the platen.

BRIEF DESCRIPTION OF THE ACCOMPANYING DRAWINGS

Figure 4:
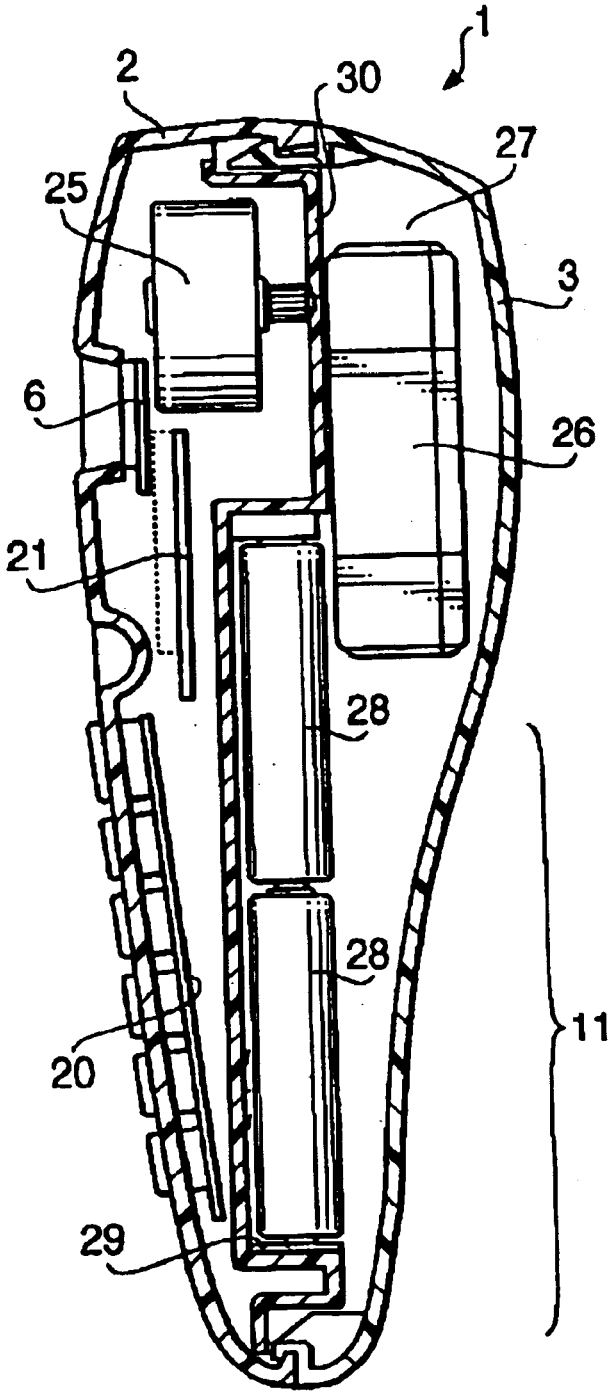
Figure 5:
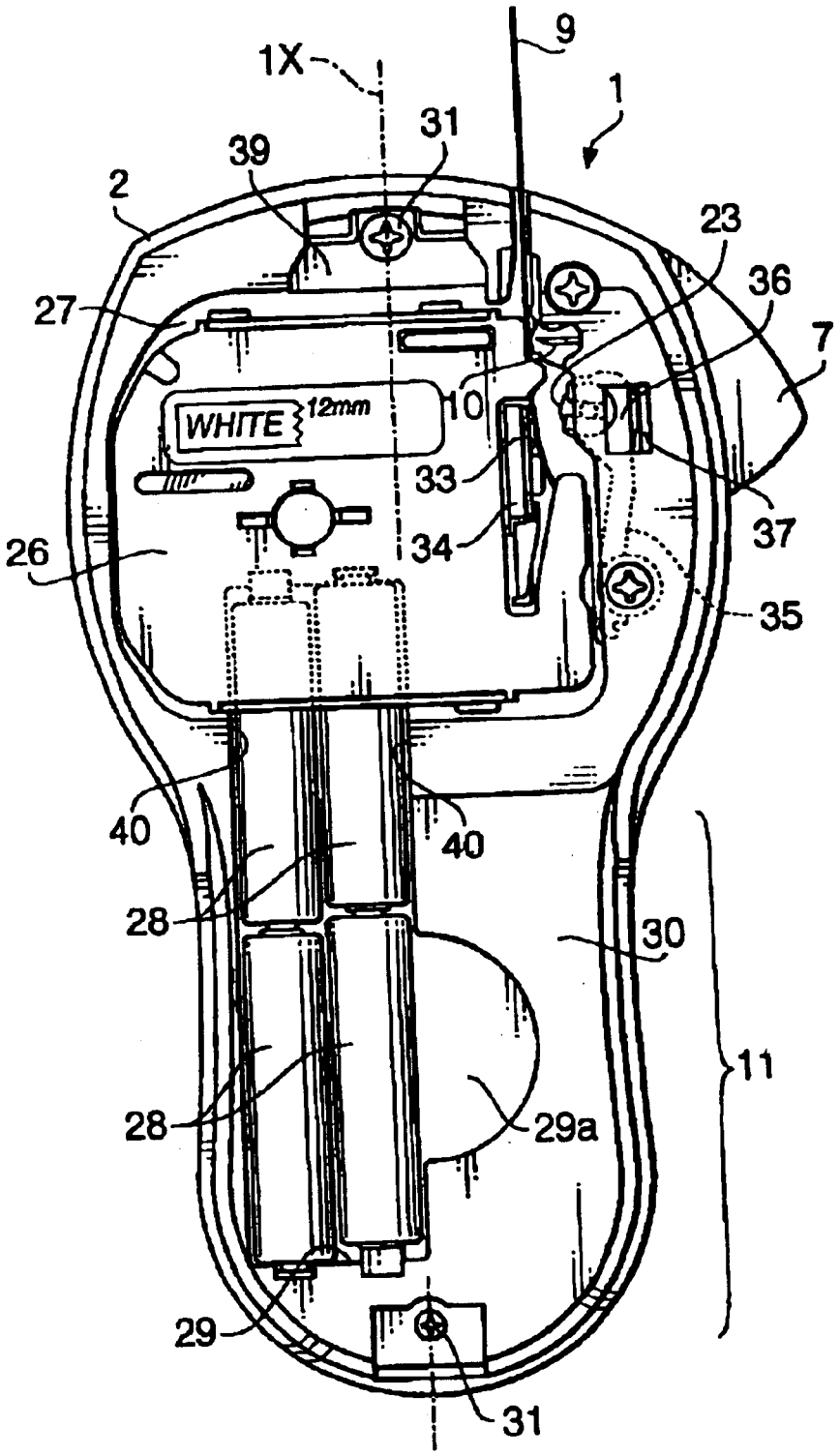
Figure 6:
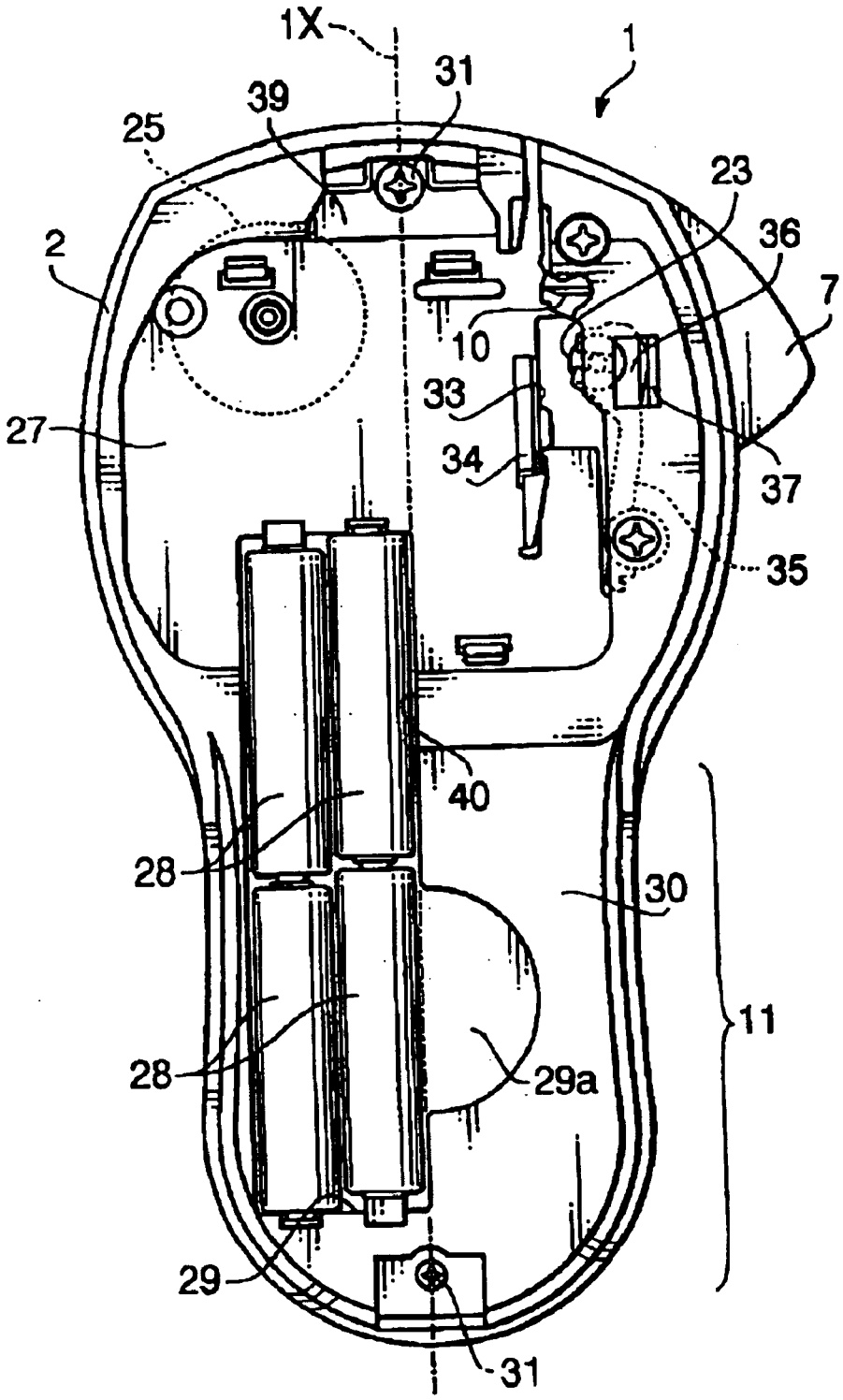
Figure 7:
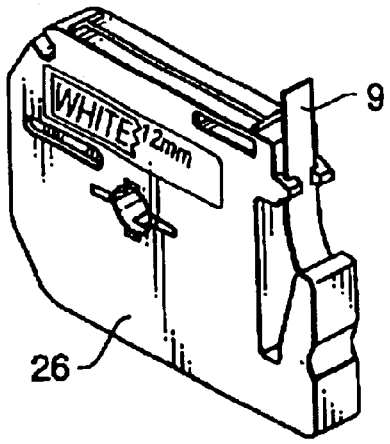
Figure 8:
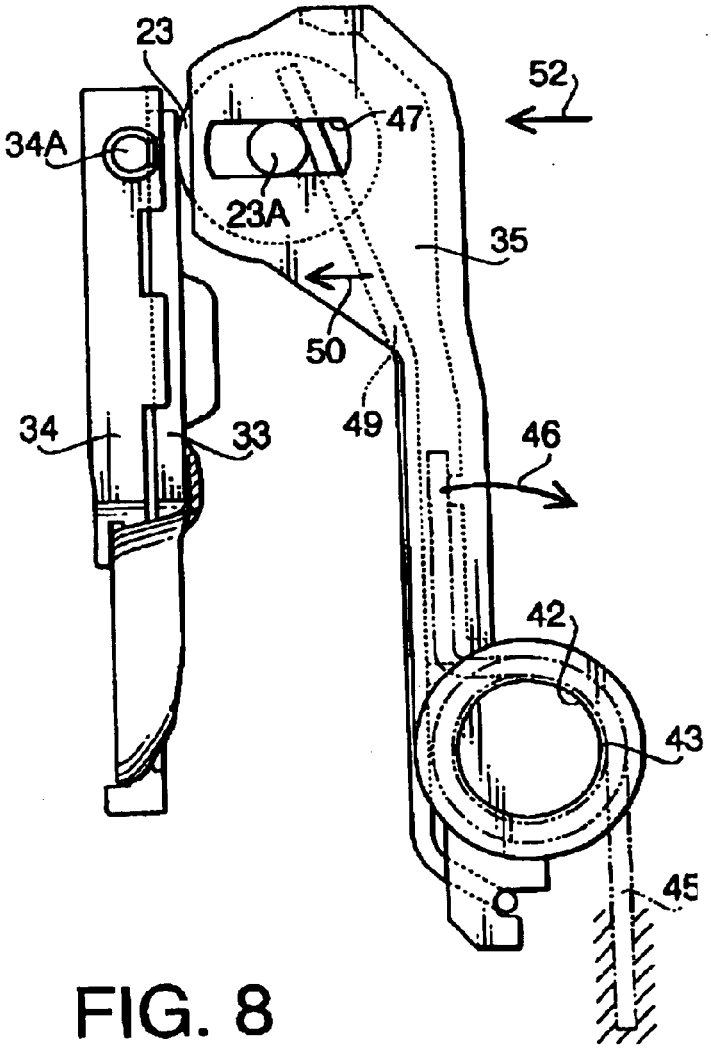
Figure 9:
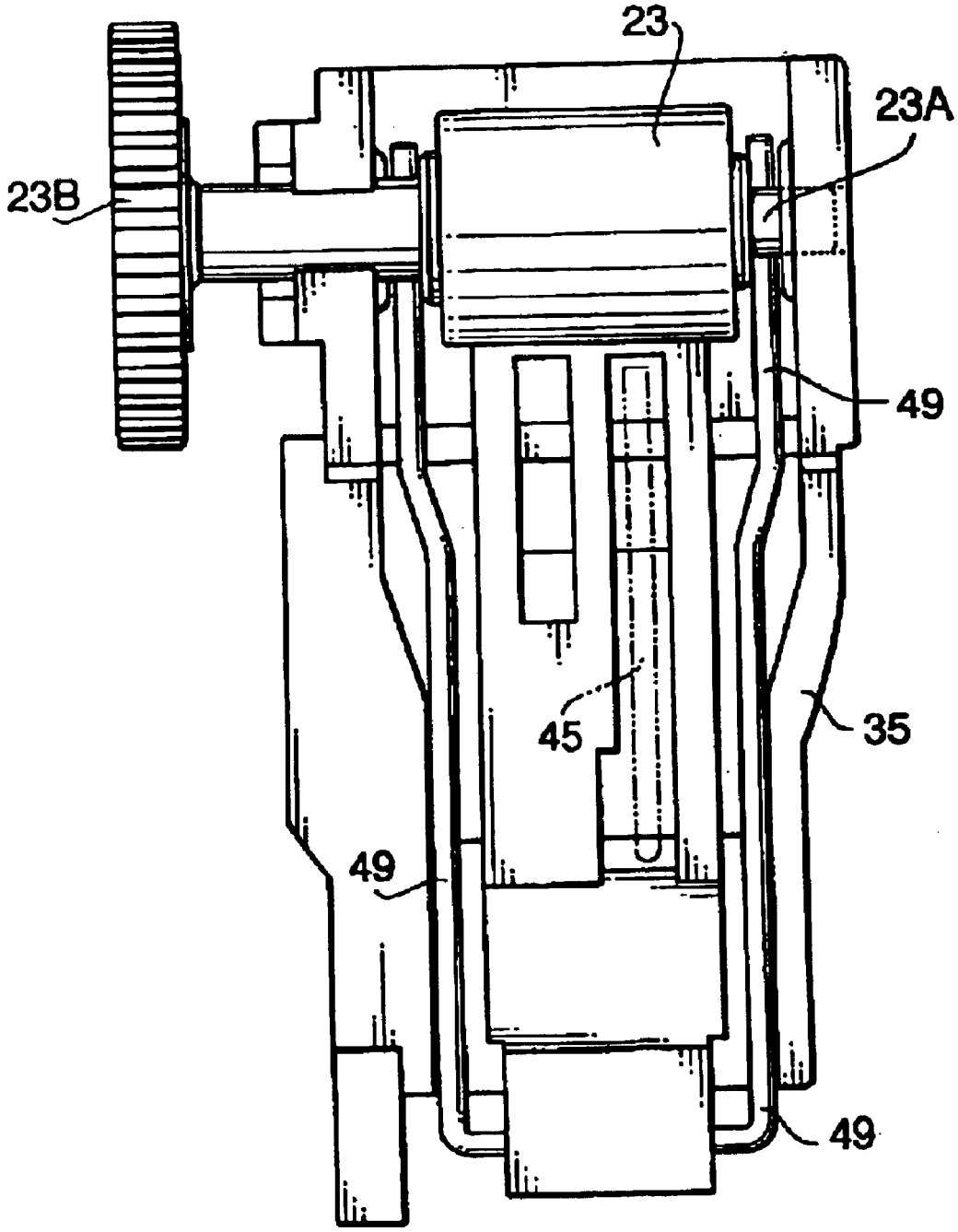
Figure 10:
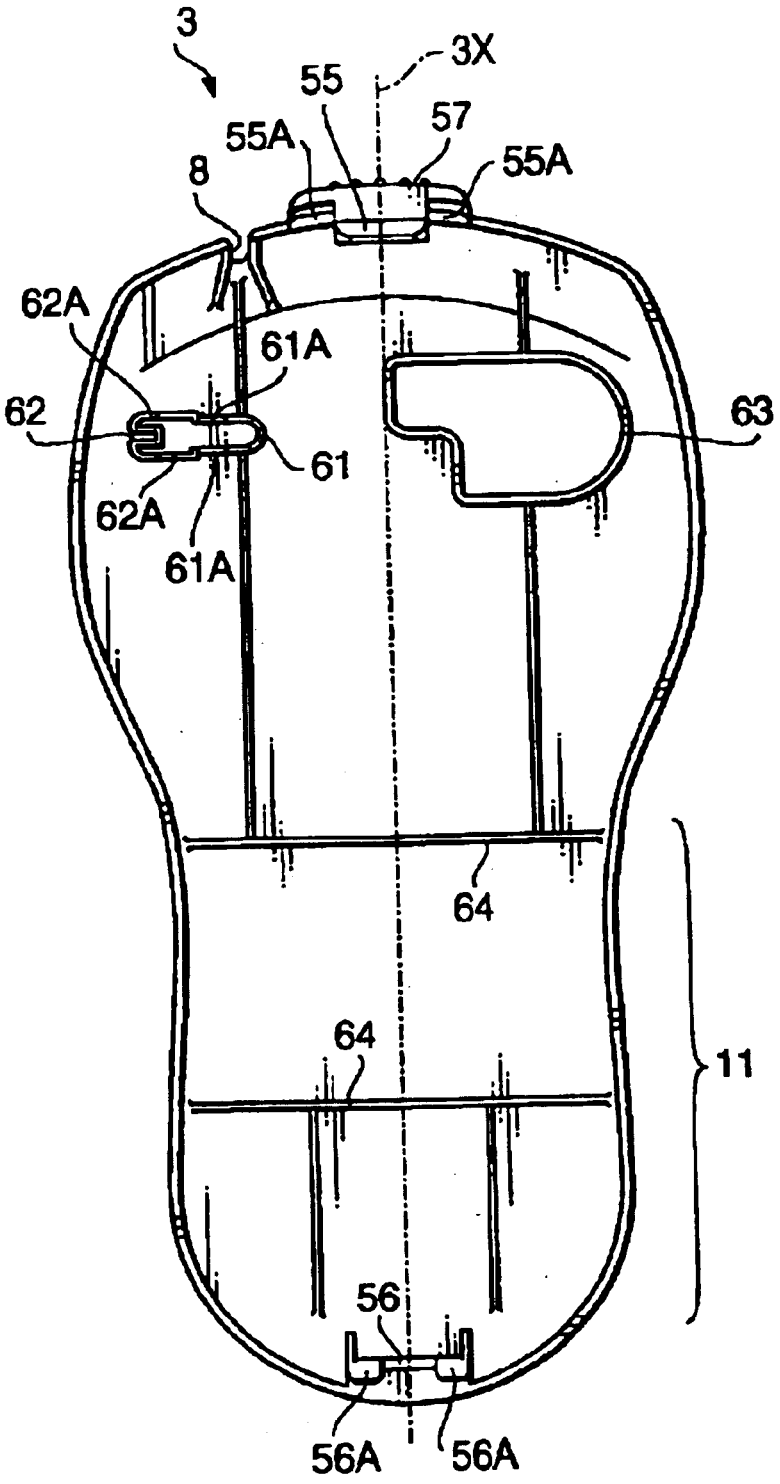
Figure 11A:
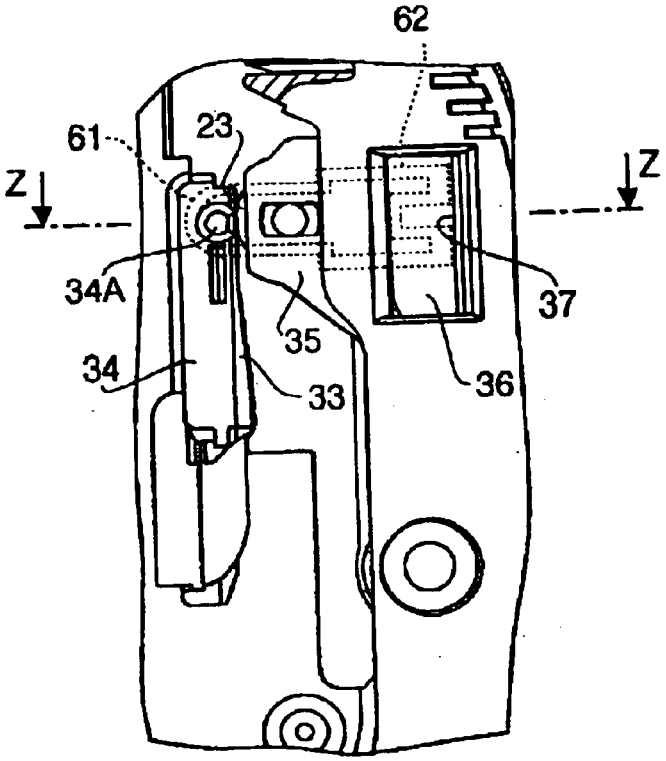
Figure 11B:
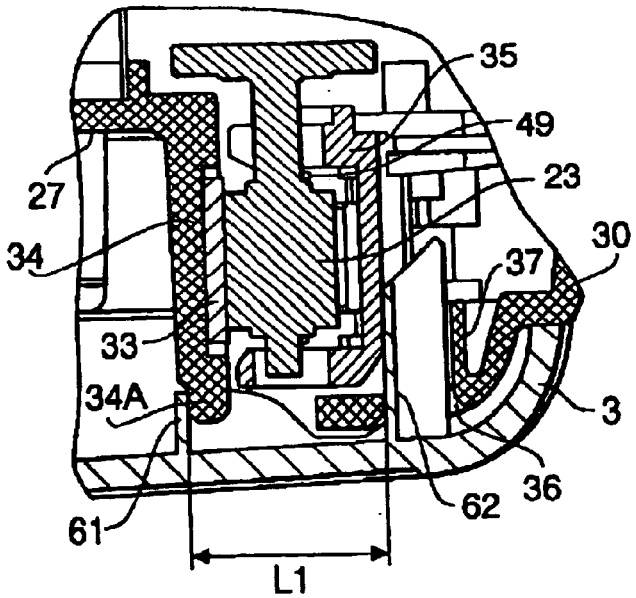
Figure 12:
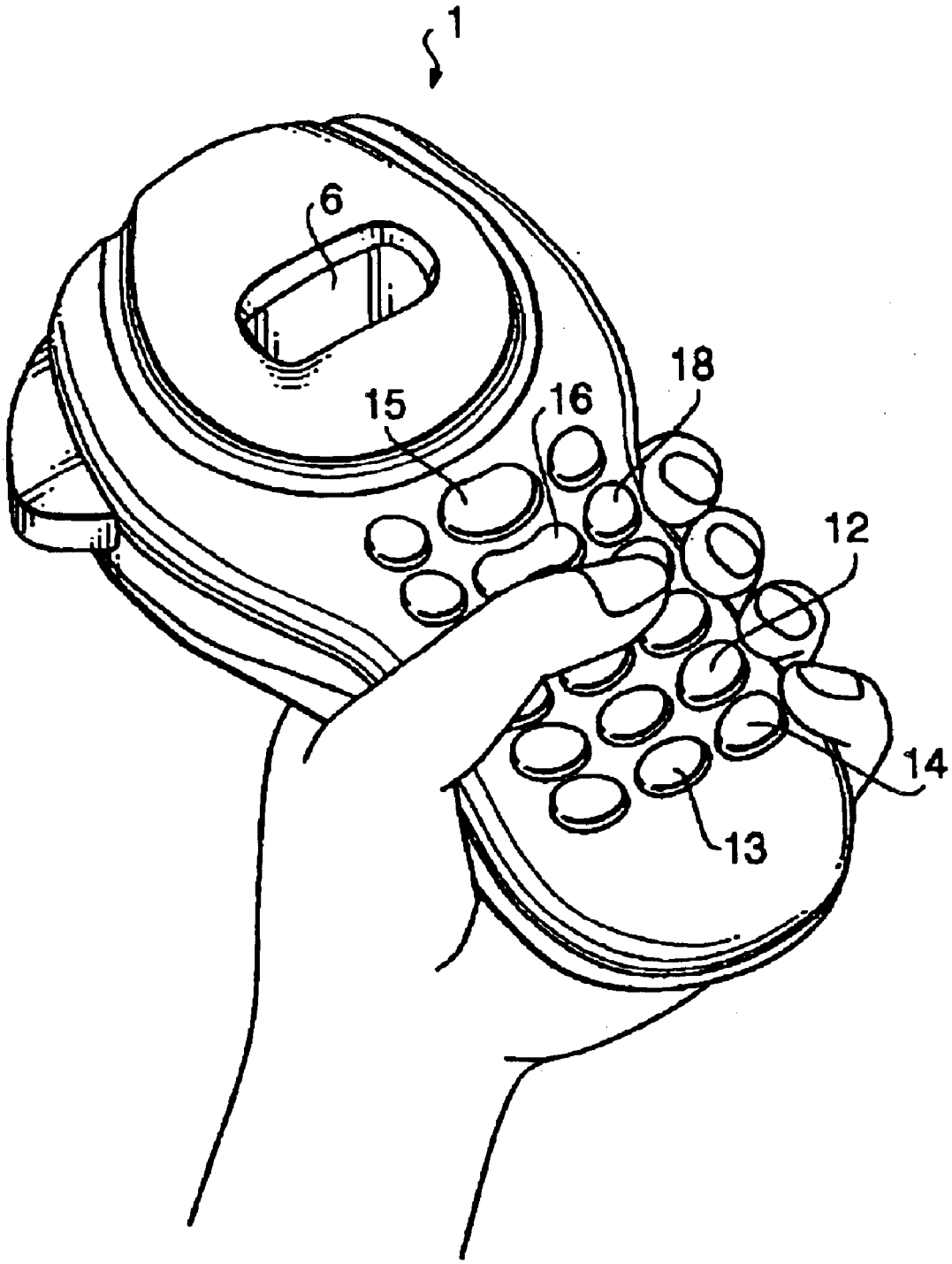
Figure 13:
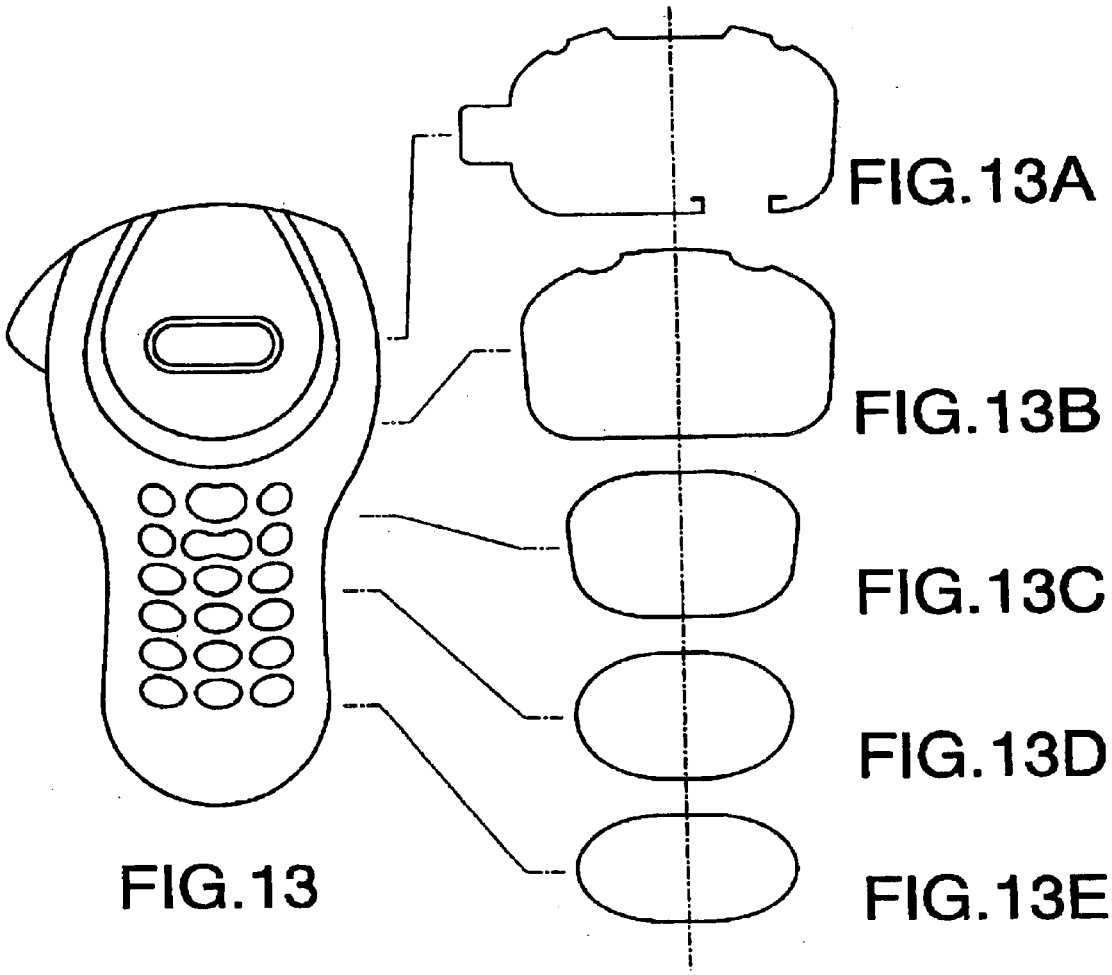

FIG. 4 a cross sectional side view of the tape printing device according to the embodiment;

FIG. 5 is a rear view of the tape printing device with a back cover being removed and a tape cassette being attached;

FIG. 6 is another rear view of the tape printing device with the back cover and the tape cassette being removed;

FIG. 7 is a perspective view of the tape cassette to be employed in the tape printing device according to the embodiment;

FIG. 8 an enlarged rear view showing a platen holder pressed against a thermal head;

FIG. 9 an enlarged side view of the platen holder;

FIG. 10 is a plan view showing an inner surface of the back cover of the tape printing device according to the embodiment;

FIG. 11A an enlarged partial rear view showing a portion around the thermal head;

FIG. 11B is a sectional view taken along a line Z—Z in FIG. 11A;

FIG. 12 is a perspective view showing the tape printing device held in a left hand of a user; and FIGS. 13 and 13A–13E show outline shapes of the tape printing device at various longitudinal positions.

DETAILED DESCRIPTION OF THE EMBODIMENT

Hereinafter, a tape printing device 1 according to an embodiment of the invention will be described in detail with reference to the accompanying drawings.

First, the general configuration of the tape printing device 1 will be described with reference to FIGS. 1 through 4.

Figure 1:
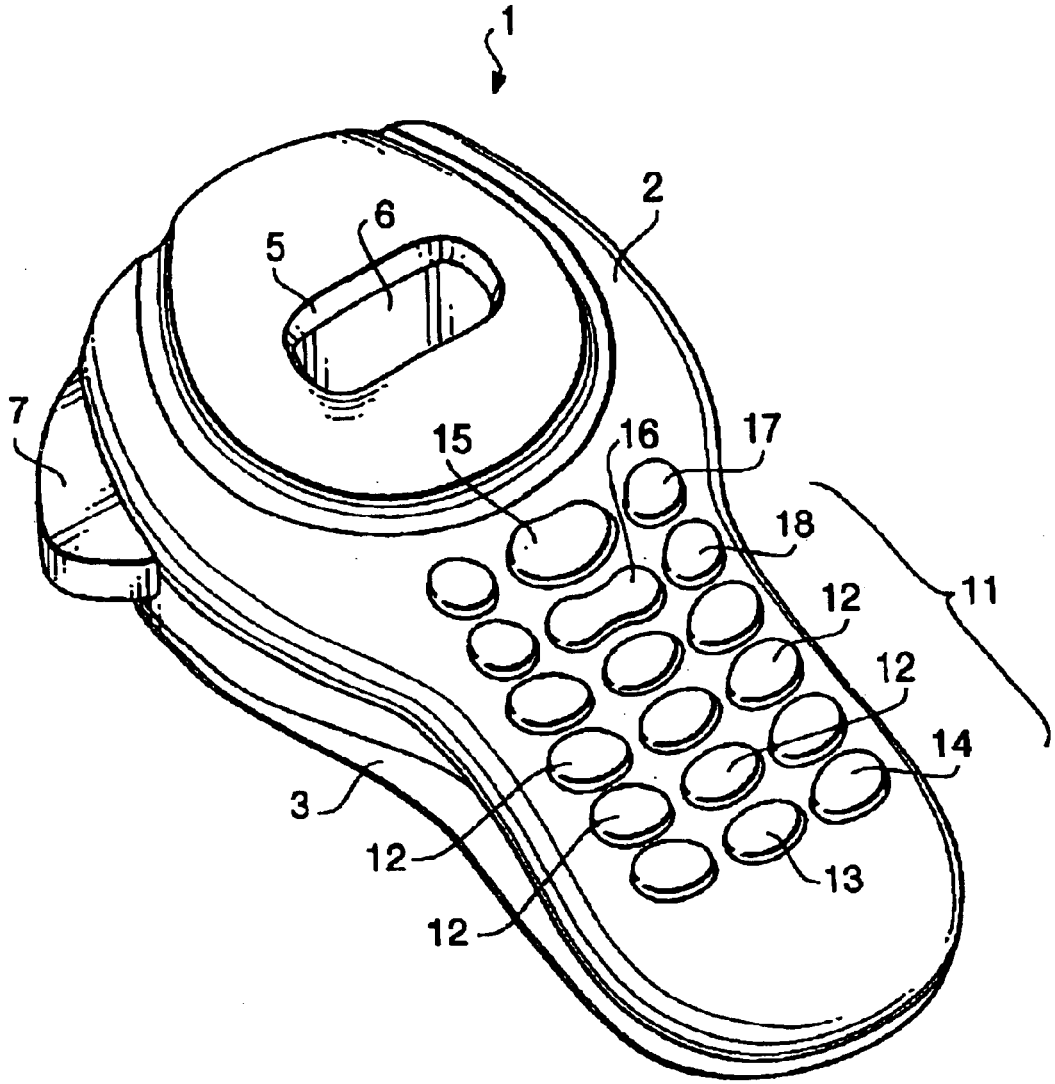
FIG. 1 is a perspective view showing an appearance of a tape printing device according to an embodiment.
Figure 2:
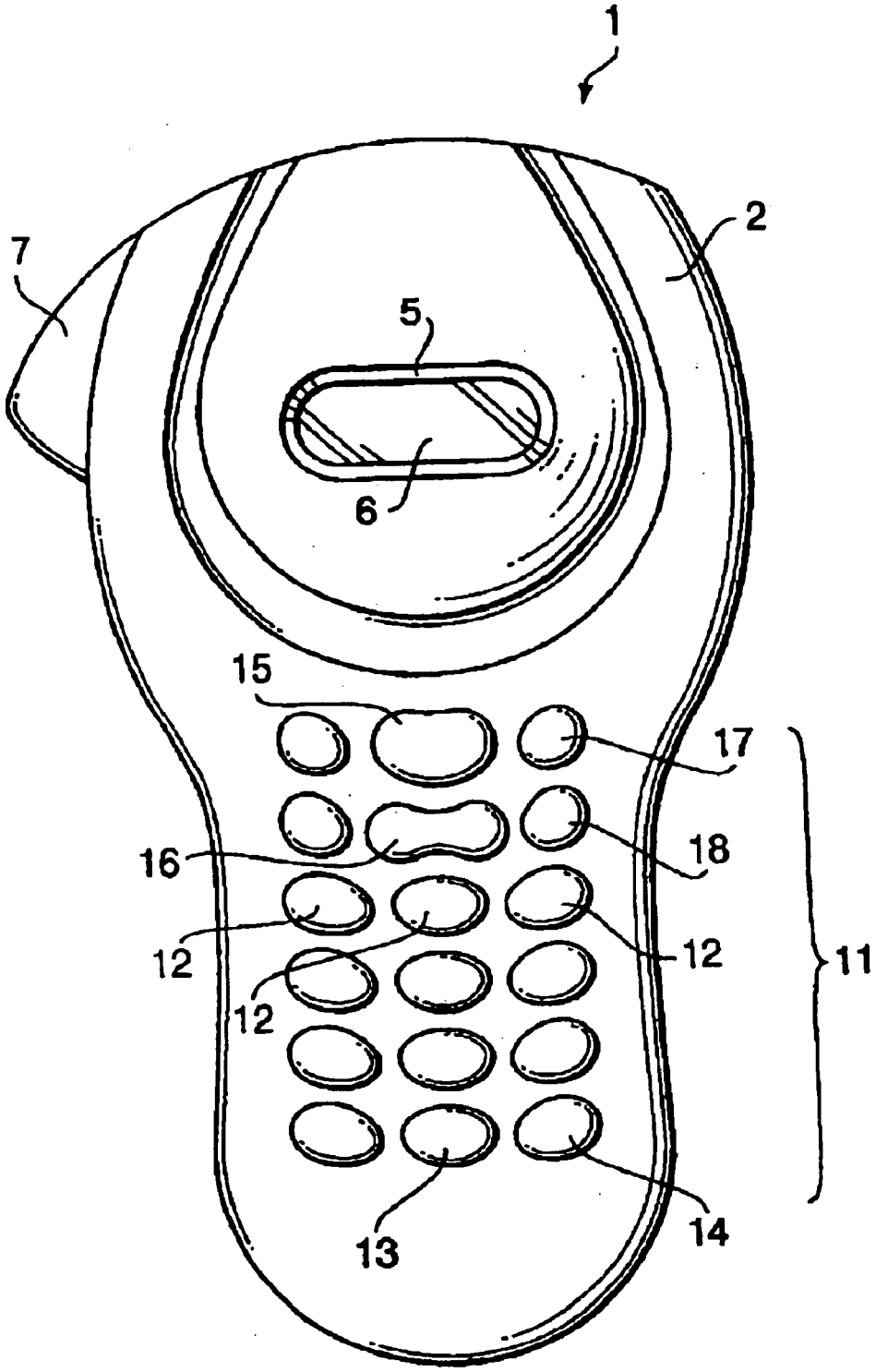
FIG. 2 is a front view of the tape printing device according to the embodiment.

As shown in FIGS. 1 through 4, the tape printing device 1 has a body 2 made of synthetic resin and a back cover 3 made of synthetic resin. The back cover 3 is detachably attached to the body 2 so that it covers the rear side, which is a side opposite to a front side that faces a user using the tape printing device 1, of the body 2. As shown in FIG. 2, the tape printing device 1 is longer in an up and down direction in FIG. 2 than in a width direction (i.e., a right and left direction in FIG. 2). A substantially upper half of the body 2 in the longitudinal direction thereof is formed such that it has a rather round shape when viewed from the front (as shown in FIG. 2). A window 5 is opened at a substantially central area of the surface of the upper half of the body 2. The window 5 extends in right and left direction in FIG. 2. A liquid crystal display (LCD) 6 is provided at the window 5. On a left side of the upper half of the body 2, a cutting lever 7 is provided. A thermal tape 9 that is printed and discharged from a tape discharging opening 8 (see FIG. 3) formed at an upper end of the tape printing device 1 can be cut by a cutter 10 (FIG. 5), which will be described later, by pressing the cutting lever 7 inwardly, with a thumb, for example.

A substantially lower half of the body 2 in the longitudinal direction thereof, which constitute a gripping portion 11, is formed to have a width slightly smaller than the width of the upper half of the body 2, and corners at right and left sides thereof are rounded so as to provide an easy grip. Further, corners at right and left sides of a portion of the back cover 3 corresponding to the gripping portion 11 are also, rounded, which also provide an easy grip feel.

The back cover 3 attached to the body 2 is formed such that the thickness of the tape printing device 1 gradually decreases from a portion where a tape cassette 26 is accommodated toward the gripping portion 11. The gripping portion 11 is formed to have a thickness smaller than the thickness of the portion accommodating the tape cassette 26. The gripping portion 11 is configured so that a user can easily hold it in his/her hand. FIGS. 13 and 13A–13E show outlines of the cross sections of the body 2 with the back cover 3 attached thereto at various longitudinal positions of the tape printing device 1.

Various keys formed of soft rubber are provided on the front surface of the gripping portion 11. The keys include character input keys 12 for inputting alphanumerical characters and various symbols to create a text of document data, a space key 13 for entering a space, a case shift key 14 that carries out a case shift when it is pressed, a print key 15 for inputting a command instructing text printing, a cursor key 16 for moving a cursor to right and left on the LCD 6 that displays characters and symbols input through the character input keys 12, a power button 17 that is operated to power ON/OFF the tape printing device 1, and a return key 18 to be operated to select a letter selection or the like.

A plurality of characters are assigned to one character input key 12. Thus, a character displayed on the LCD 6 changes among a plurality of characters when the same when one of the character input keys 12 having indications "a, b, c, 2" printed on the top surface thereof is depressed, the characters "a", "b", "c", and "2" are displayed cyclically in sequence at a cursor position on the LCD 6 at each depression of the character input key 12. When the character input key 12 is depressed when the character "2" is displayed, "a" is displayed. The character displayed on the LCD 6 is entered when the return key 18 is depressed. Further, when the case shift key 14 is depressed, the case of the character displayed at the cursor position on the LCD 6 is switched between a lowercase and an uppercase. For example, when "a" is displayed at the cursor position of the LCD 6, by depressing the case shift key 14, the letter is changed to "A". Similarly, when the case sift key 14 is depressed, a letter "b" at the cursor position is switched to "B", or a letter "C" at the cursor position is switched to "c". The change is established when the return key 18 is depressed.

As shown in FIG. 4, a circuit board 20 is provided inside the gripping portion 11 of the body 2 below the front surface of the gripping portion 11. The character input keys 12, the space key 13, the case shift key 14, the print key 15, the cursor key 16, the power button 17, the return key 18 are arranged on a top surface of the circuit board 20. A control circuit board 21, on which a control circuit is provided, is disposed inside the body 2 at a position between the gripping portion 11 and the LCD 6. Further, a driving motor 25 is disposed in a space of the body 2 in a space that is defined on an opposite side of the control circuit board 21 with respect to a thermal head 33. As shown in FIG. 4, the driving motor 25 is located at the upper end portion inside the body 2. The driving motor 25 is provided to rotatably drive a platen roller 23 via a not shown gear mechanism.

As shown in FIGS. 4–6, a partition member 30 made of synthetic resign is fixed to the body 2 by means of screws 31 (see FIGS. 5 and 6) at an opening thereof defined behind the circuit board 20, the control circuit board 21, the LCD 6 and the driving motor 25. As will be described later, a cassette holding section 27 for receiving the tape cassette 26 (see FIGS. 4–6) and a battery holding section 29 that accommodates a plurality of batteries (four batteries in the present embodiment) with each two batteries arranged along the longitudinal direction of the body 2 (see FIGS. 5 and 6) are formed on a rear side of the partition member 30.

Next, the structure of the partition member 30 will be described with reference to FIGS. 5 and 6.

As shown in FIG. 6, the cassette holding section 27 is defined on the partition member 30 on the upper half in the longitudinal direction of the body 2. The cassette holding section 27 is formed to have a substantially rectangular shape viewed from the rear (as shown in FIGS. 5 and 6) that is substantially the same as the outside shape of the tape cassette 26, which is shown in FIG. 7. Further, portions surrounding the cassette holding section 27 are formed to be protrude portions that protrude toward the back cover side of the tape printing device 1 so that the depth of the cassette holding section 27 with respect to the protruded portions is substantially the same as the thickness of the tape cassette 26.

On a bottom surface of the cassette holding section 27 at an end portion nearer to the cutting lever 7 (i.e., at a right-hand side end in FIG. 5 or FIG. 6), a thin plate like thermal head mounting portion 34, on which the thermal head 33 is to be mounted, is provided. The thermal head mounting portion 34 is formed to extend along the longitudinal direction of the body 2, and stands perpendicularly (i.e., in a direction perpendicular to a plane of FIG. 5 or FIG. 6) from the bottom surface of the cassette holding section 27. The thermal head is mounted on the outer side (i.e., the tape cutter side) of the thermal head mounting portion 34.

A cutout is formed on a right-hand side-portion (in FIG. 6) of the protruded potions defining the cassette holding section 27, facing the thermal head 33. A platen holder 35 is provided on the rear side of the partition member 30 at the cutout portion such that the platen holder 35 is swingable about a boss 43 (see FIG. 8), to which a through hole 42 formed on a gripping portion side end of the platen holder 35 (see FIG. 8) is fitted. The tape printing device 1 is configured such that, when the back cover 3 is detached from the body 2, the platen holder 35 is biased outward by a torsion spring 46 (see FIG. 8), and located at a position (which will be referred to hereinafter as a "standby position") at which the platen holder 35 abuts a position fixing member 37 that is formed at an outward side (tape cutter side) of a substantially rectangular engaging hole 36 formed on the partition member 30, and extends toward the front surface of the tape printing device 1.

Hereinafter, the structure of the platen holder 35 will be described with reference to FIGS. 8 and 9.

As shown in FIGS. 8 and 9 and as aforementioned, the platen holder 35 is rotatably supported by the boss 43 formed on the partition member 30. The circular through hole 42 formed on the platen holder 35 at the lower end in the longitudinal direction thereof is fitted on the boss 43. The platen holder 35 is biased outward (in a direction of arrow 46 in FIG. 8) by the torsion spring 45. The platen holder 35, at the upper end portion in the longitudinal direction thereof along a plane perpendicular to the longitudinal direction of the tape printing device 1, is formed to have a substantially U-shaped cross section, and through holes 47 are formed on top and bottom surfaces of the upper end portion of the platen holder 35. Each of the through holes 47 has a substantially rectangular shape, when viewed from the rear of the body 2. Each through hole 47 is long in a direction substantially orthogonal to the longitudinal direction of the platen holder 35 (i.e., in the right-and-left hand direction in FIG. 8).

Rotation shafts 23A of the platen roller 23 are rotatably inserted into the through holes 47 on both sides of the U-shaped portion of the platen holder 35. One of the rotation shafts 23A (the one on the left hand side in FIG. 9) extends toward the back side of the partition member 30 (i.e., toward the front side of the body 2), and a platen gear 23B is provided on an end thereof. The rotation shafts 23A are biased inward (in a direction indicated by arrow 50 in FIG. 8) by a pressing spring 49. The pressing spring 49 is supported at an outer side of a lower end portion of the platen holder 35 in the longitudinal direction thereof and has a substantially U-like shape which is long in the longitudinal direction of the platen holder 35. Thus, when the platen holder 35 is fixed at the standby position, the rotation shafts 23A of the platen holder 35 are pressed against the thermal head 33 sides of the through holes 47 by the biasing force of the pressing spring 49.

An abutting protrusion 34A is formed on the back cover side surface of the thermal head mounting portion 34 at a location corresponding to a portion to which the platen roller 23 is urged. The abutting protrusion 34A has a substantially circular shape viewed from the rear of the body 2, and protrudes toward the back cover side by a predetermined length. It should be noted that the shape of the abutting protrusion 34A viewed from the rear of the body 2 need not be limited to the circular shape. As an alternatively, a semicircular shape having the planar surface facing on the platen roller 23 side may be employed.

As shown in FIGS. 5 and 6, the cutting lever 7 is biased by a not shown spring so that the cutting lever 7 swings outward. A cutter 10 is slidably supported by a not shown cutter supporting mechanism which also supports the cutting lever 7 slidably. When the cutting lever 7 is pressed inward, the supporting mechanism moves the cutter 10 toward the tape cassette 26 and cuts the thermal tape 9 located thereat.

As shown in FIGS. 5 and 6, a first gap 39 large enough for inserting a finger is formed at a middle of an upper end side, in the longitudinal direction of the body 2, of the cassette holding section 27.

The battery holding section 29 is formed on a portion of the partition member 30, which is located in the gripping portion 11, at a side opposite to the thermal head 33 with respect to a longitudinal center line 1X (see FIG. 5), i.e., below the driving motor 25 in the longitudinal direction of the body 2. The battery holding section 29 has an elongated rectangular shape when observed from the rear of the body 2 and accommodates four batteries 28 (which are size AA batteries in the present embodiment) with each two batteries 28 arranged and connected along the longitudinal direction of the body 2. The battery holding section 29 is formed such that it steps down, from the bottom of the cassette holding section 27, toward the front surface side (left-hand-side in FIG. 4) by a depth that is slightly larger than the diameter of the batteries 28. The battery holding section 29 extends in the longitudinal direction of the body 2 such that the upper end of the battery holding section 29 is located in the cassette holding section 27 by a predetermined length. Thus, a portion of the batteries 28 is located on the front surface side with respect to the tape cassette 26 when the batteries 28 and the tape cassette 26 are attached to the body 2. A portion of the cassette holding section 27 facing the battery holding section 29 is cut out to form a second gap 40 that allows a finger to be inserted above the batteries 28 held in the battery holding section 29 when the tape cassette 26 is detached from the tape holding section 29.

A recess 29*a* is formed on a thermal head side (the left-hand side in FIG. 6) of the battery holding section 29 defined in the gripping portion 11. The recess 29*a* has a semicircular shape when observed from the rear side of the body 2, and a finger can be inserted thereinto. The bottom of the recess 29A is substantially at the same level of the bottom of the battery holding section 29.

When the back cover 3 is removed as shown in FIGS. 5 and 6, the platen holder 35 is located at the standby position and the tape cassette 26 can be taken out of the cassette holding section 27 by inserting fingers through the first gap 39 and the second gap 40. When the tape cassette 26 is removed from the cassette holding section 27, each battery 28 can be removed by inserting the finger through the recess 29A, and thus the batteries 28 can be exchanged. After the batteries 28 are exchanged, the tape cassette 26 is placed back in the tape holding section 27 and the back cover 3 is attached on the body 2. When the back cover 3 is attached to the body 2, the platen holder 35 swings and is located at the operating position, thereby the tape printing device 1 being operable (see FIGS. 11A and 11B).

Next, a mechanism for swinging the platen holder 35 toward the thermal head 33 and positioning it thereat when the back cover 3 is attached to the body 2 will be described with reference to FIGS. 10, 11A and 11B.

First, the back cover 3 will be described with reference to FIG. 10. As shown in FIG. 10, the back cover 3 is provided with resilient engaging pieces 55 and 56 at middle positions, in the width direction, of upper and lower end portions, in the longitudinal direction, of the back cover 3. The engaging pieces 55 and 56 are formed to extend toward the body side (i.e., in a direction perpendicular to and upward from a plane of FIG. 9). Further, engaging protrusions 55A and 56A are formed at both sides, in a width direction, of a top of each of the resilient engaging pieces 55 and 56. The engaging protrusions 55A and 56A engage resiliently with upper and lower end portions of the partition member 30 in the longitudinal direction thereof. With this structure, the back cover 3 is resiliently secured to the back side of the body 2.

A pressing portion 57 protrudes outward from a base of the resilient engaging piece 55 at the upper side in the longitudinal direction. By pressing the pressing portion 57 inward (i.e., in the downward direction in FIG. 10), each engaging protrusion 55A of the resilient engaging piece 55 is detached from the partition member 30, and the back cover 3 can be removed easily from the back side portion of the body 2.

Figure 3:
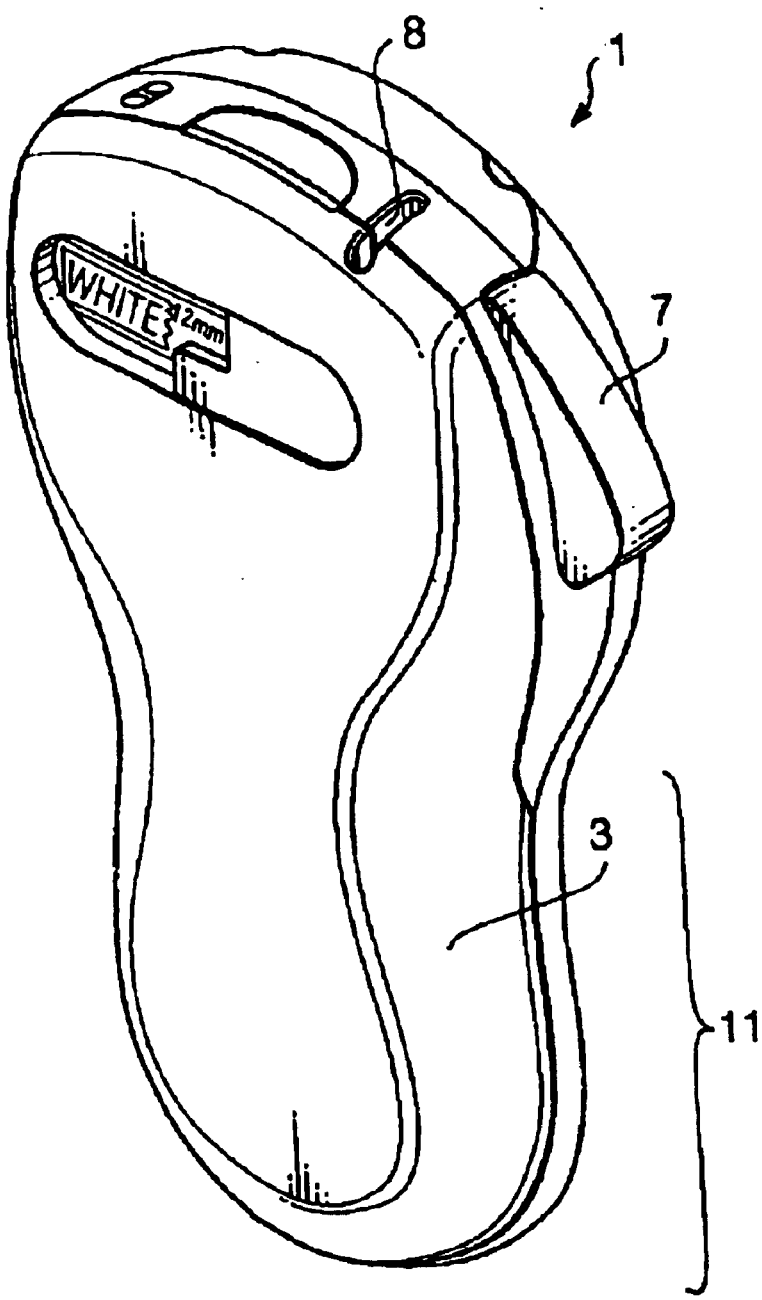
FIG. 3 is a perspective view of the tape printing device according to the embodiment, viewed from an upper-rear direction.

A tape discharging opening 8 is formed beside the resilient engaging piece 55 at the upper side of the back cover 3 in the longitudinal direction thereof (see FIGS. 10 and 3).

A regulating piece 61 having a semi-circular horizontal section and a protrusion portion 62 having a substantially w shape horizontal section are formed below, in the longitudinal direction, the tape discharging opening 8. The regulating piece 61 is formed to protrude substantially perpendicularly from the inner surface of the back cover 3 at a position corresponding to the abutting protrusion 34A formed at the top end of the thermal head mounting portion 34. When the back cover 3 is attached to the body 2, the regulating piece 61 substantially engages with the abutting protrusion 34A so as to restrict the deformation of the thermal head mounting member as will be described later.

The protrusion portion 62 is formed to protrude substantially perpendicularly on the inner surface of the back cover 3 at a position corresponding to the engaging hole 36 of the partition member 30. Further, as shown in, FIG. 11B, the height of the regulating piece 61 from the inner surface of the back cover 3 is adjusted such that the regulating piece 61 faces the outer surface of the abutting protrusion 34A in the width direction thereof when the back cover 3 is attached to the back side of the body 2. Further, as shown in FIG. 11B the height of the protrusion portion 62 from the inner wall of the back cover 3 is adjusted such that the protrusion portion 62 is inserted through the engaging hole 36 and interposed between the side portion of the platen holder 35 and the position fixing member 37 when the back cover 3 is attached to the body 2.

First ribs 61A extending outward in the width direction from both side portions of the regulating piece 61, and second ribs 62A extending inward in the width direction from both side portions of the protrusion portion 62 are joined at a substantially middle portion between the regulating piece 61 and the protrusion portion 62 to form a rib portion having a substantially rectangular cross sectional shape. The firs ribs 61A and the second ribs 62A have a substantially constant height. The tip of the protrusion portion 62 is inclined such that the height on the outer side is greater than the height on the inner side as shown in FIG. 11B. Therefore, the protrusion portion 62 can easily be interposed between the platen holder 35 and the position fixing member 37.

A cassette holding rib 63 is formed on an opposite side of the regulating piece 61 with respect to the longitudinal center line 3X. The cassette holding rib 63 has a height that substantially reaches the top surface (i.e., the surface facing the inner wall of the back cover 3) of the tape cassette 26 when the back cover 3 is attached to the body 2.

The back cover 3 is provided with a pair of battery holding ribs 64, which are formed on the inner wall at the gripping portion 11 at an upper portion of the gripping portion 11 and at a substantially middle portion of the gripping portion 11, in the longitudinal direction of the back cover 3. The pair of battery holding ribs 64 are formed to extend in a direction substantially perpendicular to the longitudinal direction of the back cover 3 over the entire width of the back cover 3. Each battery holding rib 64 is formed to protrude substantially perpendicularly to the inner wall of the back cover 3 at a height that reaches the top surface (i.e., the back cover side surface) of the partition member 30 to hold the batteries 28 in place when the back cover 3 is attached to the body 2.

Next, a configuration for swinging the platen holder 35 toward the thermal head 33 and holding it thereat will be described with reference to FIGS. 11A and 11B.

FIG. 11A an enlarged partial plan view showing a portion around the thermal head 33, and FIG. 11B is a cross sectional view taken along line Z—Z in FIG. 11A. As shown in FIGS. 11A and 11B, when the back cover 3 is attached to the body 2, the protrusion portion 62 provided on the inner surface of the back cover 3 is inserted through the engaging hole 36 and interposed between the side portion of the platen holder 35 and the position fixing member 37 (the protrusion portion 62 being shown as a cross section by dotted lines). As a result, the platen holder 35 swings toward the thermal head 33, while due to the urging force of the torsion spring, the platen holder 35 is held at a position where the side portion of the platen holder 35 abuts the inner side of the protrusion portion 62 (i.e., the operating position). When the platen holder 35 is swung to the operating position, the platen roller 23 is urged toward the thermal head 33, thus, the platen roller 23 moves outward (i.e., toward the right-hand-side in FIG. 11A) along the through holes 47 with bending the pressing spring 49 since the platen roller 23 is pressed against the thermal head 33. With this structure, the platen roller 23 can press the thermal tape 9 located between the platen roller 23 and the thermal head 33 against the thermal head 33 by a pressing force corresponding to bending amount of the pressing spring 49.

The regulating piece 61 provided on the inner surface of the back cover 3 is arranged at a position where it faces the abutting protrusion 34A, which protrudes from the upper end portion of the thermal head mounting portion 34, at the side thereof opposite from the platen holder 35. In the present embodiment, a gap of about 0.1–0.3 mm is formed between the regulating piece 61 and the abutting portion 34, taking a manufacturing error in account.

With this arrangement, as shown in FIG. 11B, even if the pressing force of the platen roller 23 to bent the thermal head mounting portion 34 inward is applied, the inward displacement of the thermal head mounting portion 34 is restricted by the engagement of the abutting protrusion 34A with the regulating piece 61, and the creep deformation can be prevented. Further, the operating position of the platen holder 35 relative to the thermal head mounting portion 34 is kept at a fixed position that is determined by the distance L1 between the regulating piece 61 and the protrusion portion 62, and hence the pressing force applied to thermal tape 9 by the platen roller 35 to press the thermal tape 9 against the thermal head 33 is kept constant.

When the platen holder 35 is fixed at the operating position, the platen gear 23B provided on the back side end portion of the platen roller 23 engages with the not shown gear mechanism, which is rotatably driven by the driving motor 25, to drive the platen roller 23 to rotate and feed the thermal tape 9 printed by the thermal head 33.

It should be noted that the thermal tape 9 accommodated in the tape cassette 26 is configured such that color is developed when heat is applied by the thermal head 33. Thus, the thermal energy required for each heater element of the thermal head 33 can be kept lower than that in printing on a tape by a thermal ink ribbon, and the heating temperature of the thermal head can be suppressed at a lower level. Therefore the creep deformation of the thermal head mounting portion 34 due to the heat generated by the thermal head 33 can be suppressed. Further, the thermal tape 9 may be one having an adhesive previously applied on the back side thereof and a release tape tentatively adhered on the adhesive layer.

Next, the operation of the tape printing device 1 will be described with reference to FIG. 12.

As shown in FIG. 12, the operator holds the gripping portion 11 of the tape printing device 1 with his/her left hand with the LCD 6 displaying the printing data. The operator creates desired printing data with ease by pressing the character input keys 12, the space key 13, the case shift key 14, the cursor key 16, and the return key 18 using the thumb of the left hand. When the print key 15 is pressed with the left hand thumb, the thermal tape is printed. Then, the cutting lever 7 is pressed inward by the thumb of the left hand, which currently holds the tape printing device 1, to cut the thermal tape 9, on which the desired printing data is printed and is discharged from the tape discharging opening 8. Thus, the operator can obtain a tape on which arbitrary data is printed by using only the left hand which is holding the gripping portion 11 of the tape printing device 1.

When the back cover 3 is attached to the body 2, the platen holder 35 moves to the operating position and the thermal head 33 is pressed by the platen roller 23 with the tape located therebetween. When the thermal head mounting portion 34, which is a thin plate like member on the side of which the thermal head 33 is mounted, is applied with a force to bend the same toward the direction pressed by the platen roller 23, the thermal head mounting portion 34 is supported on both sides thereof in the bending direction since the abutting protrusion 34A provided on the outer end portion of the thermal head mounting portion 34 abuts the regulating piece 61 formed on the inner surface of the back cover 3 in a vicinity of the surf ace of the abutting protrusion 34A on the side thereof opposite from the platen holder 35. With this configuration, the bending deformation of the thermal head mounting portion 34 due to the pressing force of the platen roller 23 can be avoided and the thermal tape 9 can be printed at an uniform quality. In particular, since the thermal head mounting portion 34 is supported at both sides in the direction where the bending force is applied due to the pressing force of the platen roller 23 when the back cover 3 is attached to the body 2, the creep deformation of the thermal head mounting portion 34 can be prevented effectively even in the case it is stored or used for a long time in high temperatures environment, and hence deterioration of the printing quality can be prevented for a long time.

The abutting protrusion 34A is formed on the end portion of the thermal head mounting portion 34 so that it faces the rotation shaft 23A of the platen roller 23 when the platen holder 35 is located at the operating position. Since the abutting protrusion 34A and the platen roller 23 face to each other when the back cover 3 is attached to the body 2, the thermal head mounting portion 34 is reliably supported at both sides to which the pressing force of the platen roller 23 works. With this structure, the bending deformation of the thermal head mounting portion 34 due to the pressing force of the platen roller 23 can be prevented more reliably, and the abutting protrusion 34A can be made compact, and hence the device body can be made compact with ease.

When the thermal head mounting portion 34 is bent by the pressing force from the platen roller 23 as the back cover 3 is attached to the body 2, the abutting protrusion 34A having a substantially circular horizontal section abuts the regulating piece 61 having a substantially semicircular horizontal section into which the abutting portion can be inserted. Thus, the abutting protrusion 34A is supported inside the regulating piece 61 in the thermal head's pressing direction irrespective of the direction thereof. Therefore, the thermal head mounting portion 34 can be reliably supported at both sides thereof in the bending direction thereof.

When the back cover 3 is attached to the body 2, the protrusion portion 62 provided on the inner surface of the back cover 3 presses the outer side of the platen holder 35 to move the platen holder 35 from the standby position to the operating position against the force of the torsion spring 45 that biases the platen holder 35 to swing from the operating position to the standby position. Therefore, the platen holder 35 can be automatically moved to the operating position with a simple structure, and the tape printing device 1 can be made compact and the manufacturing cost thereof can be reduced.

Since the cassette holding section 27 and the thermal head mounting portion 34 are made of synthetic resin, they can be simultaneously made by means of resin molding which enables a large amount of reduction of the manufacturing cost. Further, since bending deformation of the resin thermal head mounting portion 34 due to the pressure applied by the platen roller 23 can be minimized with use of the regulating piece 61 of the back cover 3, the deformation of the resin thermal head mounting portion 34 due to high temperature creep is prevented. Thus, the tape printing quality can be kept uniform and deterioration of the printing quality of the thermal tape 9 can be prevented for a long time.

Further, since the back cover 3 is made of synthetic resin, it can be made by resin molding which enables a large reduction of the manufacturing cost. Further, the mechanical strength of the resin regulating piece 61 and the resin protrusion portion 62 is enhanced by the first ribs 61A and the second ribs 62A. Therefore, deformations of the resin regulating piece 61 and the resin protrusion portion 62 due to high temperature creep or the like are prevented. Thus, printing quality of the thermal tape 9 can be kept uniform and deterioration of the printing quality of the thermal tape 9 can be prevented for a long time. Further, since the first ribs 61A and the second ribs 62A are joined between the regulating piece 61 and the protrusion portion 62 to form the rib portion having a substantially rectangular cross section, the regulating piece 61 and the protrusion portion 62 can be easily formed by resin molding with a distance L1 therebetween of high accuracy. Thus, the pressing force of the platen roller 23 can be kept at a constant load, and hence the printing quality of the thermal tape 9 can be kept more uniform and deterioration of printing quality of the thermal tape 9 can be reliably prevented for a long time.

It should be noted that the present invention is not limited to the embodiment described above and various changes and modifications may be made without departing from the scope of the invention. For example, although the abutting protrusion 34A is formed to have a substantially circular horizontal cross section in the embodiment described above, it may be formed to have a substantially semicircular horizontal section with a convex surface being located on the opposite side of the platen holder 35. Even with this alternative, the abutting protrusion 34A abuts the inner surface of the regulating piece 61. Thus, the abutting protrusion 34A can be supported efficiently and the mechanical strength of the abutting protrusion 34A can be improved by enlarging the section thereof.

In the above-described embodiment, the cassette holding section 27, the thermal head mounting portion 34 and the battery holding section 29 are formed on the partition member 30. Alternatively, the partition member 30 may be divided into two in the longitudinal direction thereof at the upper end of the gripping portion 11 in the longitudinal direction thereof and the cassette holding section 27 and the thermal head mounting portion 34 may be made of heat resistance resin. With such a configuration, the creep deformation of the thermal head mounting portion 34 due to high temperature can be more effectively prevented, and deterioration of the tape printing quality can be prevented reliably for a long time.

According to the embodiment, the abutting protrusion 34A is provided on the thermal head mounting portion 34 at the end portion thereof at a location corresponding to the platen roller 23. Alternatively, a plurality of abutting protrusions 34A may be provided on the thermal head mounting portion 34 on the end portion at a back cover side thereof along the longitudinal direction, and the corresponding number of regulating piece 61 may be provided on the inner surface of the back cover 3 at positions corresponding to the abutting protrusions 34A. With this configuration, twist deformation of the thermal head mounting portion 34 due to high temperature can also be prevented, and deterioration of the tape printing quality can be effectively prevented for a long time.

As described above, when the thermal head mounting portion is pressed in the pressing direction of the platen mechanism, the abutting portion provided on the cover side end portion of the thermal head mounting portion abuts the regulating member provided on the inner surface of the back cover such that it faces the surface of the abutting portion opposite from the platen mechanism. Thus, in such a tape printing device, the bending deformation of the thermal head mounting portion due to the pressing force of the platen mechanism can be prevented. Accordingly, such a tape printing device can print on a tape with uniform quality. In particular, since the thermal head mounting portion is supported at both sides (i.e., at the front side and the rear side) against the pressing force of the thermal head mounting portion, the creep deformation of the thermal head mounting portion can be prevented even when the tape printing devices is stored or used for a long time in high temperature environment. Thus, there is provided a tape printing device capable of preventing the deterioration of the tape printing quality for a long time.

According to the tape printing device described above, the thermal head mounting portion 34, which is a relatively thin plate-like member formed on the bottom of the cassette holding section, is pressed by the platen roller through the thermal head mounted on the side of the thermal head mounting portion. The thermal head mounting portion is pressed to be bent in the direction by the platen roller. However, since the abutting protrusion provided on the cover side end portion of the thermal head mounting member abuts the regulating member formed on the inner surface of the back cover, the thermal head mounting portion is supported at both sides thereof.

With this structure, the bending deformation of the thermal head mounting portion due to the pressing force of the platen mechanism can be avoided and the tape can be printed at a uniform quality. In particular, since the thermal head mounting portion is supported at both sides (i.e., at the cassette holding section side and at the back cover side) when the back cover is attached to the device body, the creep deformation of the thermal head mounting portion can be prevented even if the tape printing device is stored or used for a long time in high temperatures environment, and hence deterioration of the printing quality can be prevented for a long time.

According to the tape printing device described above, when the back cover covers the cassette holding section, the platen mechanism moves from a standby position to a operating position in association with a movement of the back cover member covering the cassette holding section. As the platen mechanism moves to the operating position and to biased toward the thermal head, accordingly the tape can be automatically pressed against the thermal head when the tape cassette is accommodated in the cassette holding section and the cover is attached to the body. Further, since the platen mechanism moves to the standby position when the cover is removed, the tape cassette can be removed from the tape cassette holding section without causing damage to the tape.

According to the tape printing device described above, since the abutting portion is formed on the back cover side end portion of the thermal head mounting member so that it faces a rotation axis of the platen roller when the platen mechanism is located at the operating position, the platen roller, which is biased toward the thermal head by the biasing mechanism, faces this abutting member. Thus, both sides of the thermal head mounting portion, which is pressed by the platen roller, are reliably supported. With this structure, the bending deformation of the thermal head mounting portion due to the pressing force of the platen roller can be reliably prevented, and the abutting portion can be made compact, and hence the device body can be made compact with ease.

According to the tape printing device described above, when the thermal head mounting portion is applied with the force to bend from the platen mechanism as the cover is attached to the device body, the abutting portion formed to have a circular horizontal section or a substantially circular horizontal section abuts the regulating member having a substantially semicircular horizontal section into which the abutting portion can be inserted. Thus, the abutting portion is supported inside the regulating member in the thermal head's pressing direction irrespective of the direction thereof. Therefore, the thermal head mounting portion can be reliably supported at both sides thereof in the bending direction thereof.

According to the tape printing device described above, since the mechanical strength of the regulating member is enhanced by the pair of the first ribs extending from both sides of the regulating member, the bending deformation due to a counter force of the regulating member for supporting the abutting portion can be prevented to achieve uniform quality printing on the tape. In particular, since the mechanical strength of the regulating member in the direction of the counter force for supporting the abutting portion is improved by the pair of the first ribs, the creep deformation of the regulating member caused by storing or using it for a long time in high temperatures environment can be prevented, and hence deterioration of the tape printing quality can be reliably prevented for a long time.

According to the tape printing device described above, when the cover member is attached to the device body, the protrusion portion provided on the inner surface of the cover member presses the outer side of the platen mechanism to move the platen mechanism from the standby position to the operating position against the swinging means that swings the platen mechanism from the operating position to the standby position. Therefore, the platen mechanism can be moved to the operating position by a simple arrangement, and the tape printing device can be made compact and the size and the manufacturing cost of the device body can be reduced.

According to the tape printing device described above, since the mechanical strength of the protrusion portion is improved by the pair of the second ribs extending from both sides of the protrusion portion, the bending deformation due to the counter force of the protrusion for pressing the platen mechanism can be prevented to achieve uniform tape printing quality. In particular, since the mechanical strength of the protrusion portion in the direction of the counter force pressing the platen mechanism is improved by the pair of the second ribs when the cover is attached to the device body, the creep deformation of the protrusion portion caused by storing or using it for a long time in high temperatures environment can be prevented, and hence deterioration of the tape printing quality can be reliably prevented for a long time.

According to the tape printing device described above, since the first ribs and the second ribs are joined between the regulating member and the protrusion portion to form a rib portion having a substantially rectangular horizontal section, the mechanical strength of the regulating member and the protrusion portion can be further improved, and the first ribs and the second ribs can be downsized, and hence the device body can be downsized with ease.

According to the tape printing device described above, sine the cassette holding section and the thermal head mounting portion are made of resin, they can be formed simultaneously by resin molding and a deep cut of the manufacturing cost can be achieved. Further, the bending deformation of the resin thermal head mounting portion caused by the pressing force of the platen mechanism can be reduced to a minimum by the regulating member of the cover. Therefore, the deformation of the resin thermal head mounting portion due to high temperature creep or the like is prevented and the tape printing quality can be kept uniform and deterioration of the tape printing quality can be prevented for a long time.

According to the tape printing device described above, since the cover is made of resin, it can be made of resin molding, and hence a deep cut of the manufacturing cost there of can be achieved. Further, the mechanical strength of the resin regulating member and the resin protrusion portion provided on the inner surface of the cover is improved by the first ribs and the second ribs. Therefore, deformations of the resin regulating member and the resin protrusion portion due to high temperature creep or the like are prevented. Thus, tape printing quality can be kept uniform and deterioration of the tape printing quality can be prevented for a long time. Further, since the first ribs and the second ribs are joined between the regulating member and the protrusion portion to form the rib portion having a substantially rectangular horizontal section, the regulating member and the protrusion portion can be easily formed by resin molding with a distance therebetween of high accuracy. Thus, the pressing force of the platen mechanism can be kept at a constant load, and hence the tape printing quality can be kept further uniform and deterioration of tape printing quality can be reliably prevented for a long time.

The present disclosure relates to the subject matter contained in Japanese Patent Application No. 2002-369504, filed on Dec. 30, 2002, which is expressly incorporated herein by reference in its entirety.

What is claimed is:

1. A tape printing device that prints letters/characters on a tape-form thermal recording medium, comprising:

a device body, a cassette holding section being formed in said device body to accommodate a tape cassette containing the tape-form recording medium;

a cover member that covers said cassette holding section;

a thermal head that applies heat to print letters/characters on the tape-form recording medium;

a thermal head mounting portion formed on a bottom of said cassette holding section, said thermal head mounting portion including a plate-like member that protrudes from the bottom of said cassette holding section toward said cover member, said thermal head being attached to a side of said plate-like member; and a platen mechanism having a platen which faces said thermal head and is biased toward said thermal head, wherein said thermal head mounting portion has an abutting member, wherein said cover member has a regulating member, said abutting member and said regulating member being configured such that said abutting member abuts said regulating member from a direction opposite to a direction in which said platen is biased toward said thermal head at least when said cover member covers said cassette holding section, deformation of said plate-like member urged by said platen being prevented as a displacement of said abutting member is prevented by said regulating member.

2. The tape printing device according to claim 1, wherein said abutting member includes a protruded member protruding from a side end surface of said plate-like member.

3. The tape printing device according to claim 2, wherein said regulating member is formed on an inner surface, which faces said thermal head mounting portion, of said cover member.

4. The tape printing device according to claim 3, wherein said protruded member has a substantially circular cross section along a plane perpendicular to a protruding direction of said protruded member.

5. The tape printing device according to claim 4, wherein said regulating member has a receiving portion that receives said protruded member, at least a portion of said receiving portion abutting said protruded member having a concave shape fitting to the shape of said protruded member.

6. The tape printing device according to claim 3, wherein said protruded member has a substantially semicircular cross section along a plane perpendicular to a protruding direction of said protruded member, a convex surface of said protruded member facing said regulating member.

7. The tape printing device according to claim 6, wherein said regulating member has a receiving portion that receives said protruded member, at least a portion of said receiving portion abutting said protruded member having a concave shape fitting to the shape of said protruded member.

8. The tape printing device according to claim 1, wherein said platen mechanism is configured such that said platen moves between an operating position at which said platen is biased toward said thermal head and a standby position at which said platen is retracted from said operating position; and wherein said abutting member faces said regulating member only when said platen is located at said operating position.

9. The tape printing device according to claim 1, wherein said cover member is detachably attached to said body, and wherein said platen mechanism is configured such that said platen moves between an operating position at which said platen is biased toward said thermal head and a standby position at which said platen is retracted from said operating position in association with attachment/detachment of said cover member with respect to said body.

10. The tape printing device according to claim 1, wherein said platen mechanism has a moving mechanism that moves said platen between the operating position and the standby position, wherein said cover member has a protrusion portion formed on the inner surface of said cover member, said protrusion portion affecting said moving mechanism to move said platen.

11. The tape printing device according to claim 10, wherein said abutting member includes a protruded member protruding from a side end surface of said plate-like member, and wherein said regulating member is formed on the inner surface, which faces said thermal head mounting portion, of said cover member.

12. The tape printing device according to claim 11, wherein said cover member has a pair of first ribs, said first ribs being formed on said inner surface of said cover member and extending from both sides of said regulating member.

13. The tape printing device according to claim 12, wherein said cover member has a pair of second ribs, said second ribs being formed on said inner surface of said cover member and extending from both sides of said protrusion portion.

14. The tape printing device according to claim 13, wherein said first ribs and said second ribs are joined between said regulating member and said protrusion portion.

15. The tape printing device according to claim 11, wherein a distance between said regulating member and said protrusion portion is determined such that said platen is urged against said thermal head at a predetermined force.

16. The tape printing device according to claim 15, wherein said regulating member and said protrusion portion are formed integrally with said cover member.

17. The tape printing device according to claim 10, wherein said regulating member and said protrusion portion are formed integrally with said cover member.

18. The tape printing device according to claim 1, wherein said thermal head mounting member and said cassette holding section are formed of resin.

19. The tape printing device according to claim 1, wherein said cover member is made of resin.

20. The tape printing device according to claim 1, wherein said thermal head mounting member is formed integrally with said cassette holding section.

21. The tape printing device according to claim 8, wherein said platen mechanism includes a platen roller, and a biasing mechanism that biases said platen roller toward said thermal head, and wherein said abutting portion is formed on the cover member side end portion of said thermal head mounting portion such that it faces a rotation axis of said platen roller when said platen mechanism is at the operating position.

22. The tape printing device according to claim 8, wherein said platen mechanism has a swinging mechanism that swings said platen mechanism from the operating position to the standby position about a fixed point, wherein said cover member has a protrusion portion formed on said inner surface, and wherein said protrusion portion presses an outer side of said platen mechanism to move said platen mechanism from the standby position to the operating position against said swinging means.

23. A tape printing device that prints letters/characters on a tape-form thermal recording medium, comprising:

a device body;

a cover member that covers detachably attached to said device body;

a thermal head that applies heat to the tape-form recording medium so as to print letters/characters thereon;

a thermal head mounting portion provided to said device body, said thermal head mounting portion including a plate-like member that extends from said device body toward said cover member, said thermal head being attached to a side of said plate-like member;

a platen mechanism having a platen which faces said thermal head and is biased toward said thermal head; and a supporting mechanism provided between said thermal head mounting portion and said cover member, said supporting mechanism supporting said plate-like member from a side opposite to said platen to prevent deformation of said plate-like member due to biasing force applied by said platen.

* * * * *